United States Patent [19]

Ostendorff et al.

[11] Patent Number: 4,715,843

[45] Date of Patent: Dec. 29, 1987

[54] TOY VEHICLE PLAYSET

[75] Inventors: Eric C. Ostendorff, Torrance; James I. Tucker, Jr., Manhattan Beach, both of Calif.

[73] Assignee: Mattel, Inc., Hawthorne, Calif.

[21] Appl. No.: 778,573

[22] Filed: Sep. 20, 1985

[51] Int. Cl.[4] ..... A63H 18/00

[52] U.S. Cl. ..... 446/429; 446/444

[58] Field of Search ..... 446/444, 429; 238/10 E, 238/10 R, 10 F; 273/86 R, 86 B, 86 D; 104/67, 79, 54

[56] References Cited

U.S. PATENT DOCUMENTS

| | | | |
|---|---|---|---|
| 749,607 | 8/1903 | Dutrieu . | |
| 1,431,398 | 10/1922 | Hetzner | 104/67 X |
| 1,603,180 | 10/1926 | Zabel | 104/79 X |
| 3,204,574 | 9/1965 | Frisbie et al. | 104/54 |
| 3,209,491 | 10/1965 | Roeper | 446/444 X |
| 3,858,875 | 1/1975 | Nemeth et al. | 273/54 |
| 4,185,409 | 1/1980 | Cheng | 238/10 F X |
| 4,355,807 | 10/1982 | Prehodka | 273/86 |
| 4,423,871 | 1/1984 | Mucaro | 273/86 |
| 4,496,100 | 1/1985 | Schwager et al. | 238/10 F X |
| 4,513,966 | 4/1985. | Mucaro et al. | 238/10 F X |
| 4,513,967 | 4/1985 | Halford et al. | 273/86 D X |
| 4,519,789 | 5/1985 | Halford et al. | 446/444 |

*Primary Examiner*—Robert A. Hafer
*Assistant Examiner*—Danton D. DeMille
*Attorney, Agent, or Firm*—Ronald M. Goldman; Melvin A. Klein; Daniel F. Sullivan

[57] ABSTRACT

A toy vehicle playset includes a roadway, a booster for impelling a vehicle along the roadway, a ramp positioned in the roadway to provide a path for an impelled vehicle to leap a predetermined distance, a catcher positioned in the roadway to catch a vehicle jumping the ramp, and a return portion of the roadway slanted to stop the vehicle and return it to the end of the roadway at which the booster is situated, the ramp being designed to pivot so that it allows a toy vehicle to pass along the roadway in the opposite direction.

3 Claims, 10 Drawing Figures

TOY VEHICLE PLAYSET

BACKGROUND OF THE INVENTION

This invention relates to toys and, more particularly, to toy vehicle playsets.

There have been many toy vehicle playsets devised. In general, such playsets encompass a roadway for directing toy vehicles about a course of one sort or another and various mechanical arrangements for causing the vehicles to exhibit various exciting manuevers. There have, for example been innumerable toy playsets which include means for causing vehicles to careen around corners at apparent breakneck speed. There have been other toy playsets in which arrangements are made so that vehicles may race against one another. Other playsets provide ramps over which toy vehicles may jump. Some utilize various obstacles which the vehicles are to hit or to miss. All in all, there have been a plethora of such playsets.

It is, therefore, an object of the present invention to provide an improved toy vehicle playset.

It is another object of the present invention to provide an improved track arrangement for toy vehicle playsets including a unique ramp arrangement.

It is yet another object of the present invention to provide a toy vehicle playset allowing an operator to increase both the timing and dexterity of his reactions by utilizing a ramp arrangement.

SUMMARY OF THE INVENTION

These and other objects of this invention are realized in a toy vehicle playset which includes a roadway, a booster for impelling a vehicle along the roadway, a ramp for causing an impelled vehicle to leap a predetermined distance, a catcher portion of the roadway positioned to catch a vehicle jumping the ramp, and a return portion of the roadway slanted to stop the vehicle and return it to the end of the roadway at which the booster is situated. The ramp arrangement is designed to lift a toy vehicle up from the roadway so that it jumps a toy vehicle passing along the roadway in the opposite direction. To this end, the upper end of the ramp is pivoted so that a vehicle passing thereunder raises the lower end. By adroitly timing the release of vehicles, a first car may be boosted onto the track, caused to jump the ramp, and returned from the end to be jumped itself by a second vehicle from the booster.

Other objects and advantages of the invention will be better understood by reference to the specification taken in conjunction with the detailed drawings in which like reference numerals refer to like elements throughout the various views.

DETAILED DESCRIPTION OF THE INVENTION

Figure 1:
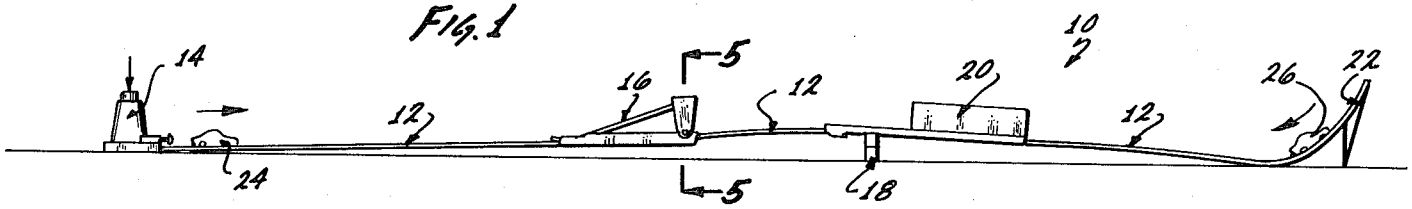
FIG. 1 is a side view of a toy vehicle playset constructed in accordance with the invention demonstrating a first position of a ramp included therewith.

Referring now to the drawings and, in particular, to FIG. 1, there is shown a toy vehicle playset 10 constructed in accordance with the invention. The toy vehicle playset 10 includes a booster 14 which may be one of many devised by the prior art to accelerate toy vehicles along a roadway. The booster 14 is joined to a track 12; the track 12 may be constructed of moldable plastic or other material well known to the prior art of which such roadways have been previously constructed. As will be seen from FIG. 1, the leftmost portion of the track 12 proceeds up a slight incline where it joins a ramp mechanism 16. The ramp mechanism 16 may also be constructed of a moldable plastic or other material known to the prior art and is conformed such as to raise a vehicle passing thereover from the left as seen in FIG. 1 so that the vehicle leaps up from the roadway.

The ramp mechanism 16 is connected at its right end to another section of the track 12 which is held above the surface of the play area by a trestle 18. The trestle 18 also supports the left end of a catcher 20 which as may be seen in FIG. 1 provides a slight downslope from left to right. The catcher 20 may be constructed of a moldable plastic or other material well known to the prior art.

The catcher 20 is connected at its right end to another section of the track 12 which is itself connected at its right end to a track return 22 configured to decelerate a vehicle traveling thereon and return it to the booster 14 at the left end of the toy vehicle playset 10.

Figure 5:
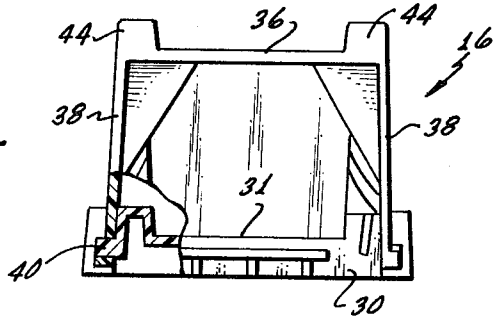
FIG. 5 is an end view of the ramp shown in FIG. 3.
Figure 3:
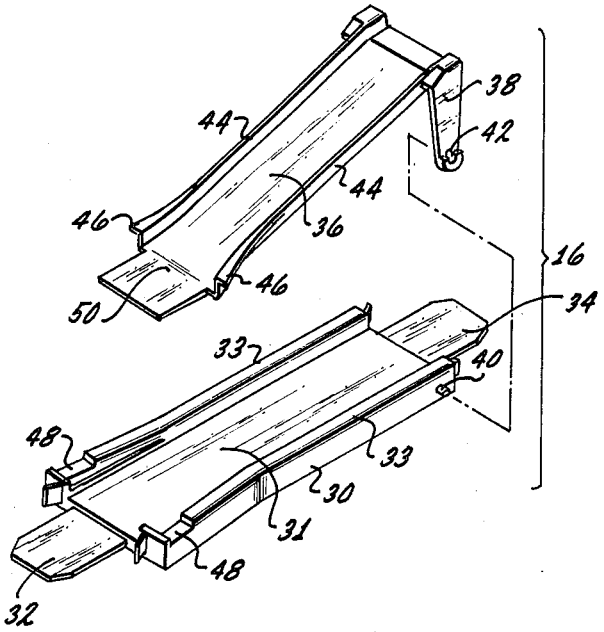
FIG. 3 is an exploded perspective view of a ramp utilized in the toy playset of FIG. 1.
Figure 4:
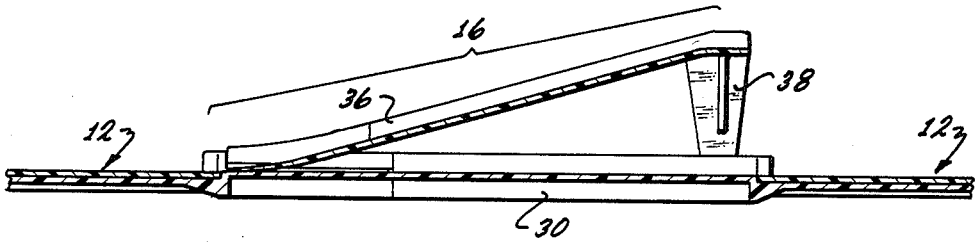
FIG. 4 is an enlarged side view of the ramp shown in FIG. 3.

FIGS. 3, 4, and 5 are enlarged views of the ramp mechanism 16 illustrated in FIG. 1. The ramp mechanism 16 includes a base 30 having a conventional roadway 31 separating a pair of sidewalls 33. A first tongue 32 and a second tongue 34 of conventional form are positioned at opposite ends of roadway 31 and aid in joining the roadway 31 to the track 12 at either end. Positioned above the base 30 is a ramp 36 which also has a roadway portion. The ramp 36 is held above the base 30 at its right end by a pair of arms 38 so that a vehicle proceeding from left to right in FIG. 4 is caused to leap upward to the right. The lower end of each arm 38 pivots in a pair of holes 42 about one of a pair of pivot axles 40 extending outward from the right end of the base 30.

The roadway of the ramp 36 separates a pair of sidewalls 44 which flare outwardly at a pair of ends 46. This flare provides a receiver which allows a toy vehicle proceeding up the ramp 36 to proceed without interference from the sidewalls 44. A roadway 50 extends from the lower left end of the ramp 36 and overlies the roadway 31 of the base 30. A pair of notches 48 are positioned in the sidewalls 33 of base 30 so that the end 50 of the ramp roadway fits tightly against the roadway 31.

Figure 7:
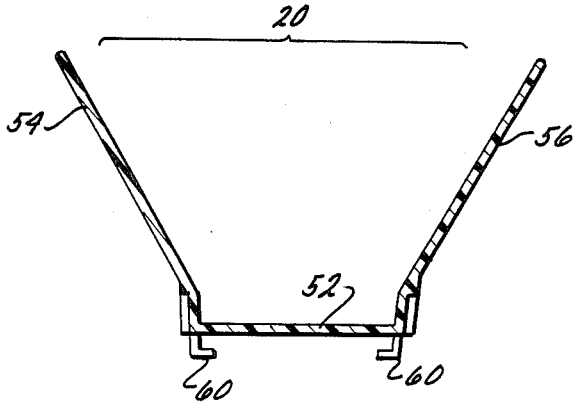
FIG. 7 is an end cross-sectional view of the catcher shown in FIG. 6.
Figure 6:
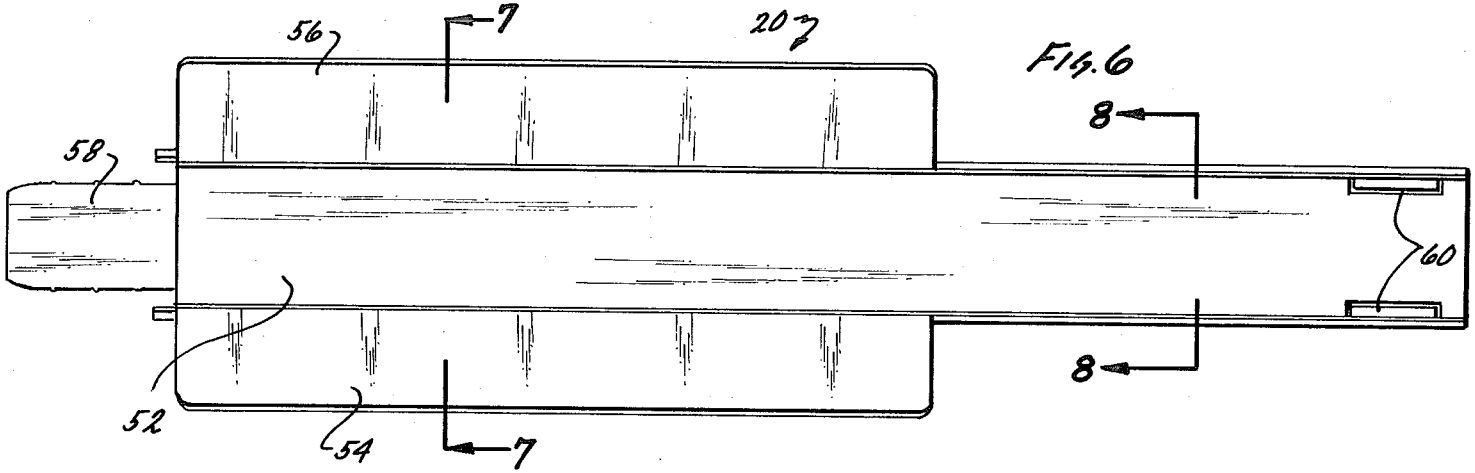
FIG. 6 is a top view of a vehicle catcher which is portion of the toy playset shown in FIG. 1.

FIGS. 6 and 7 illustrate the catcher 20 shown in FIG. 1. The catcher 20 includes a roadway 52 and a pair of outwardly slanting sidewalls 54 and 56. The sidewalls 54 and 56 each extend outward from the roadway 52 at an angle which may vary depending upon the speed of the cars, their weight and size. The sidewalls provide a large catching area for a descending vehicle. The sidewalls funnel the descending vehicle down to the roadway 52 and assure the vehicle's alignment therewith. At the ends of the roadway 52 are tongues 58 and 60 adapted to join the catcher 20 to mating grooves in the track 12. FIG. 7 illustrates in cross section the angle of the two sidewalls 54 and 56. This angle and the upward extent of the sidewalls 54 and 56 are selected to provide a sufficiently large area so that any vehicle launched over the ramp mechanism 16 will be caught and lowered to the track 12 without falling off the track 12.

Figure 8:
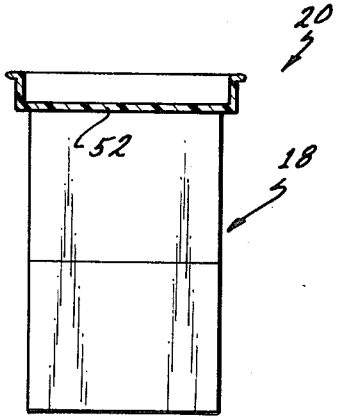
FIG. 8 is an enlarged view of a trestle used in the playset of FIG. 1.

FIG. 8 illustrates a trestle 18 which may be used with the toy vehicle playset 10 in one or more of the positions shown in FIG. 1 in order to raise the track 12 so that the ramp mechanism 16 has a slight upslope to the right and the catcher 20 has a slight downslope to the right. This slope provides a convenient arrangement for catching any vehicle proceeding over the ramp mechanism 16 because the path of such a vehicle is in the form of a parabola so that the nose of such a vehicle is heading down as it lands at the catcher 20; the downslope of the catcher 20 at this point eases its descent to the track 12. It should be noted that in a preferred embodiment constructed of moldable plastic material, the resilience of the plastic roadway at the raised portion also assists in providing an easy landing to any vehicle which has passed over the ramp mechanism 16.

Figure 9:
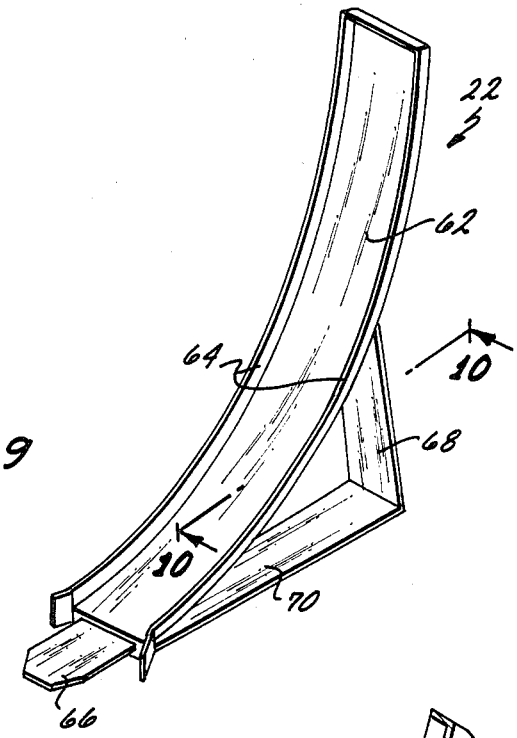
FIG. 9 is an enlarged perspective view of a return used with the playset of FIG. 1.
Figure 10:
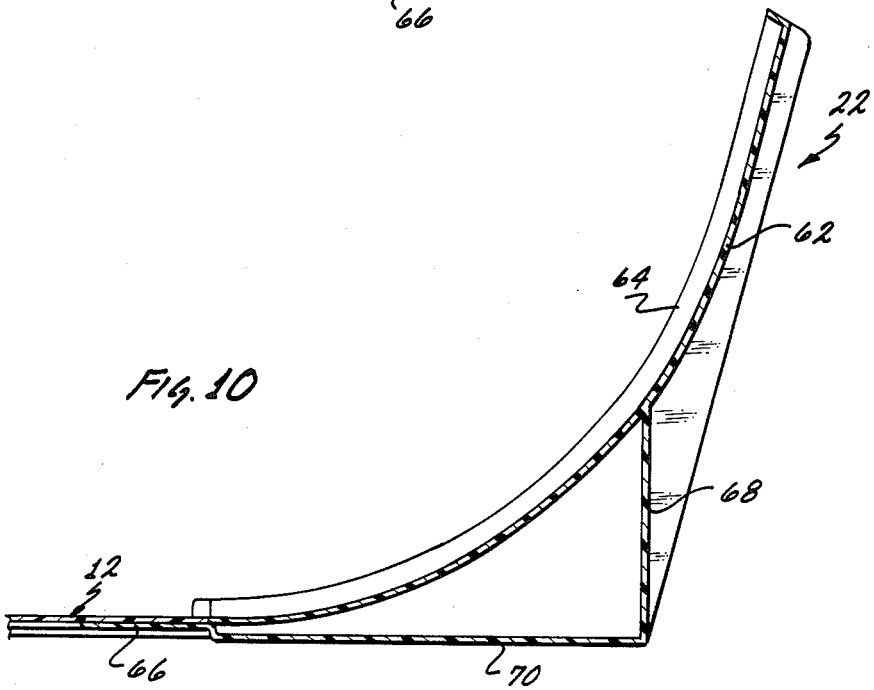
FIG. 10 is a side view in cross-section of the return of FIG. 9.

FIGS. 9 and 10 illustrate the track return 22 shown in FIG. 1. The track return 22 may also be constructed of a moldable plastic material or other material well known to the prior art. It includes an upwardly sloping roadway 62 which separates a pair of sidewalls 64. At the left end of the roadway 62 is a tongue 66 adapted to join the track return 22 to the track 12. The position of the track return 22 is maintained by an upright 68 and a base 70. The roadway 62 of the track return 22 has a gradually increasing slope so that a vehicle traveling along the track 12 is slowed, stopped, and has its direction reversed. If the slope and height of the track return 22 and the trestle 18 are selected or adjusted properly, a vehicle may be caused to return to the left end of the track 12 after traversing the track 12 from left to right.

Figure 2:
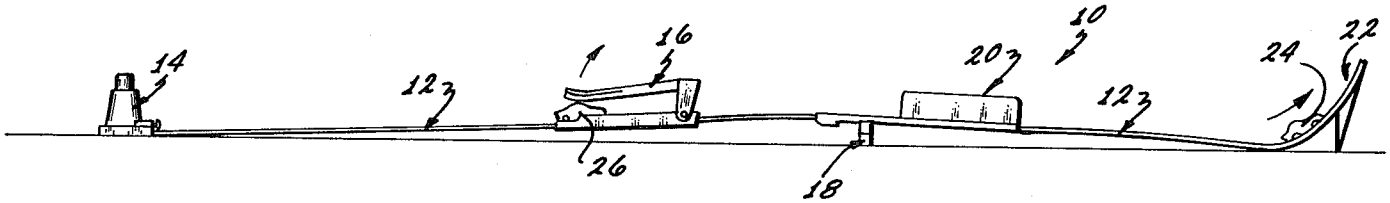
FIG. 2 is a second side view of a toy vehicle playset constructed in accordance with the invention demonstrating a second position of a ramp included therewith.

FIGS. 1 and 2 illustrate the operation of the toy vehicle playset 10 of this invention. In FIG. 1, a first auto 24 has just been ejected by the booster 14 onto the track 12 and is proceeding to the right. This first auto 24 will jump the ramp mechanism 16 and land on the roadway 31 of the catcher 20. It will then proceed to the track return 22 where it will be slowed and stopped and begin to go backwards toward a position at which a second auto 26 is shown in FIG. 1.

The second auto 26 shown in FIG. 2 has traveled back to the ramp mechanism 16 where is has raised the ramp 36 by applying pressure on the underside thereof to pivot the ramp 36 on the pair of arms 38 about the pivot axles 40. The second auto 26 will proceed leftward and complete its journey at the booster 14.

As made be understood from the Figures, an especially exciting arrangement is provided by the playset of this invention if two vehicles are used at the same time. In such a case, it is necessary that one first auto 24 jump the ramp mechanism 16 while the other second auto 26 is proceeding to the left between the ramp mechanism 16 and the catcher 20. If the second auto 26 is in any other position the two vehicles collide and the journey of each is terminated. This arrangement thus is adapted to provide for increasing the timing and coordination of any operator utilizing the toy vehicle playset 10.

While the invention has been described herein with reference to particular detailed embodiments, many modifications will occur to those skilled in the art which are within the spirit and scope of the invention. It is, therefore, intended that the invention be limited only by the language of the claims which are appended hereto.

What is claimed is:

1. A toy vehicle playset comprising a roadway; a booster for impelling a vehicle along the roadway; a ramp positioned in the roadway; means for normally arranging the ramp to direct a vehicle upward therefrom, the ramp being positioned above the roadway; pivot means supporting one end of the ramp above the roadway so that the ramp is movable in response to pressure on its underside to allow passage of a vehicle along the roadway; a catcher positioned in the roadway to catch a vehicle leaving the ramp; and a return portion of the roadway slanted to stop the vehicle and return it to the end of the roadway at which the booster is situated.

2. A toy vehicle playset as claimed in claim 1 in which the means for catching a vehicle comprises an extension of the roadway, means for connecting the extension to the roadway, and first and second walls each joining the extension of the roadway at one of the two sides thereof and extending therefrom at an angle such that the two walls form an angle with one another of less than 180 degrees whereby an extended catching surface is provided for a vehicle leaving the ramp.

3. A toy vehicle playset as claimed in claim 2 further comprising means for providing a downslope of the extension of the roadway through the catcher.

* * * * *